US009480296B2

(12) United States Patent
Wong

(10) Patent No.: US 9,480,296 B2
(45) **Date of Patent: *Nov. 1, 2016**

(54) FOOTWEAR DEVICE

(71) Applicant: Darrell L. Wong, Wayland, MA (US)

(72) Inventor: Darrell L. Wong, Wayland, MA (US)

( * ) Notice: Subject to any disclaimer, the term of this patent is extended or adjusted under 35 U.S.C. 154(b) by 229 days.

This patent is subject to a terminal disclaimer.

(21) Appl. No.: 14/079,793

(22) Filed: Nov. 14, 2013

(65) Prior Publication Data

US 2014/0068970 A1 Mar. 13, 2014

Related U.S. Application Data

(63) Continuation of application No. 13/363,548, filed on Feb. 1, 2012, now Pat. No. 8,613,150, which is a continuation of application No. 12/157,749, filed on Jun. 13, 2008, now Pat. No. 8,117,770.

(60) Provisional application No. 60/937,778, filed on Jun. 29, 2007.

(51) Int. Cl.

| | |
|---|---|
| ***A43B 5/00*** | (2006.01) |
| ***A43B 5/06*** | (2006.01) |
| ***A43B 23/02*** | (2006.01) |
| ***A43B 7/14*** | (2006.01) |
| ***A43B 7/18*** | (2006.01) |
| ***A43B 7/20*** | (2006.01) |

(52) U.S. Cl.

CPC . *A43B 5/00* (2013.01); *A43B 5/06* (2013.01); *A43B 7/14* (2013.01); *A43B 7/18* (2013.01); *A43B 7/20* (2013.01); *A43B 23/027* (2013.01)

(58) Field of Classification Search

CPC ..... A43B 5/00; A43B 5/06; A43B 7/32; A43B 23/00; A43B 23/0265; A43B 23/027; A43B 23/028

USPC ..... 36/114, 88, 140, 89; 602/23, 25, 26, 62

See application file for complete search history.

(56) References Cited

U.S. PATENT DOCUMENTS

| | | | |
|---|---|---|---|
| 979,243 | A | 12/1910 | Anderson |
| 4,089,064 | A | 5/1978 | Chandler, Jr. |
| 4,294,238 | A | 10/1981 | Woodford |
| 4,941,273 | A | 7/1990 | Gross |
| 5,090,138 | A | 2/1992 | Borden |
| 5,125,171 | A | 6/1992 | Stewart |
| 5,263,923 | A | 11/1993 | Fujimoto |
| 5,475,935 | A | 12/1995 | Frost |
| 5,621,985 | A | 4/1997 | Frost |
| 5,640,714 | A | 6/1997 | Tanaka |
| 6,397,496 | B1 | 6/2002 | Seymour |

(Continued)

OTHER PUBLICATIONS

Shoespring, Sports Biomechanics, Inc., downloaded from http://www.nichewear.com/shoe1.asp on May 26, 2004.

(Continued)

*Primary Examiner* — Marie Bays

(74) *Attorney, Agent, or Firm* — Hamilton, Brook, Smith & Reynolds, P.C.

(57) ABSTRACT

A footwear device including a resilient member having first and second ends. The first end can be configured for being connected to a user's foot, and the second end can be configured for being connected to the user's leg above the ankle joint. The resilient member can be configured and positioned for resiliently and rotatably biasing the user's foot about the ankle joint.

20 Claims, 11 Drawing Sheets

(56) References Cited

U.S. PATENT DOCUMENTS

| | | | |
|---|---|---|---|
| 6,796,058 | B2 | 9/2004 | Pochatko |
| 7,013,586 | B1 | 3/2006 | Hatfield et al. |
| 8,117,770 | B2 | 2/2012 | Wong |
| 2001/0027284 | A1 | 10/2001 | Wellershaus et al. |
| 2002/0188238 | A1 | 12/2002 | Townsend et al. |
| 2004/0255358 | A1 | 12/2004 | Ota et al. |
| 2006/0036204 | A1 | 2/2006 | Corrales |
| 2006/0149181 | A1 | 7/2006 | Guenther |
| 2007/0209235 | A1 | 9/2007 | Brunelle-Wright |
| 2008/0255490 | A1 | 10/2008 | Daley |
| 2009/0217551 | A1 | 9/2009 | Shirokikh |
| 2010/0101118 | A1 | 4/2010 | Guenther |
| 2012/0192454 | A1 | 8/2012 | Wong |

OTHER PUBLICATIONS

Spira, Sports Biomechanics, Inc., downloaded from http://www.shoespring.com/technology.html on May 26, 2004, 2001. Article.

Z-Coil® pain relief footwear TM, Z-Coil Footwear, downloaded from http://www.zcoil.com/zstyles.cfm on May 26, 2004, 2003. Article.

Z-Coil® pain relief footwear TM, Z-Coil Footwear, downloaded from http://www.zcoil.com/ztechnology.cfm on May 26, 2004, 2003. Article.

FOOTWEAR DEVICE

RELATED APPLICATIONS

This application is a continuation of U.S. application Ser. No. 13/363,548, filed Feb. 1, 2012, which is a continuation of U.S. application Ser. No. 12/157,749, filed Jun. 13, 2008, which claims the benefit of U.S. Provisional Application No. 60/937,778 filed on Jun. 29, 2007. The entire teachings of the above applications are incorporated herein by reference.

BACKGROUND

A typical approach for increasing the speed performance of running shoes is to make the shoe light weight. Any further increases in speed are usually related to the physical abilities of the user.

SUMMARY

The present invention provides embodiments of footwear devices which can increase the running speed of the user by maximizing, promoting or assisting the existing physical propulsion ability of the user.

The footwear device can include a resilient member having first and second ends. The first end can be configured for being connected to a user's foot, and the second end can be configured for being connected to the user's leg above the ankle joint. The resilient member can be configured and positioned for resiliently and rotatably biasing the user's foot about the ankle joint.

In particular embodiments, the resilient member can be formed of elastic material and can resiliently extend at the back of the user's foot. The footwear device can further include a footwear item for wearing on the user's foot. A securement member can be connected to the second end of the resilient member for securing around the user's ankle. The resilient member can resiliently extend from the back of the user's foot.

In one embodiment, the footwear item can be a sock. In another embodiment, the footwear item can be at least a lower portion of tights.

In still another embodiment, the footwear device can be a shoe. The first end of the resilient member can be connected to or extend from a rear region of the shoe and the second end of the resilient member can be connected to a resilient self tightening securement member for securing to the user's ankle. The securement member can be adjustable.

The present invention also provides a shoe for a foot including a lower shoe portion. A resilient member having first and second ends, can have the first end connected to the lower shoe portion at a rear region of the lower shoe portion. The second end of the resilient member can be configured for being connected above an ankle joint for resiliently biasing the rear region of the lower shoe portion against the foot with the resilient member being in resilient tension. This can minimize lifting of the foot within the shoe and increase running speed.

The present invention also provides a method of biasing a foot. A first end of a resilient member of a footwear device can be connected to a user's foot and a second end of the resilient member can be connected to a user's leg above the ankle joint. The resilient member can be configured and positioned for resiliently and rotatably biasing the user's foot about the ankle joint.

The present invention further provides a method of biasing a lower portion of a shoe against a foot. A first end of a resilient member can be connected to a rear region of the lower shoe portion. A second end of the resilient member can be connected above an ankle joint of the foot, with the resilient member being in resilient tension for resiliently biasing the rear region of the lower shoe portion against the foot.

BRIEF DESCRIPTION OF THE DRAWINGS

The foregoing and other objects, features and advantages of the invention will be apparent from the following more particular description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
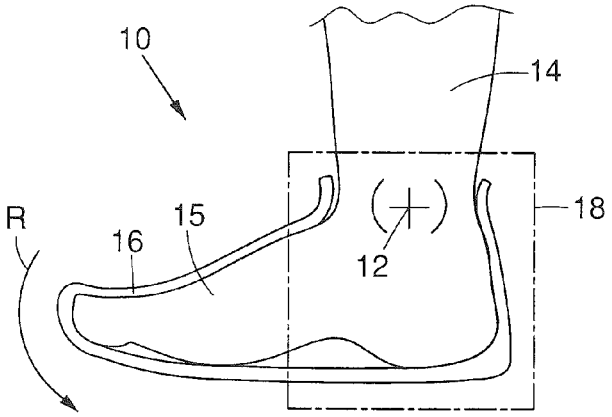
FIG. 1 is a schematic side view of an embodiment of a footwear device in the present invention.

Referring to FIG. 1, footwear device 10 generally includes a resilient assembly 18. The resilient assembly 18 can provide a user, wearing footwear device 10 on a foot 15, with a moment arm that resiliently and rotatably biases the foot 15 about an axis of rotation or a pivot point such as the ankle joint 12 in the direction of arrow R. The resilient assembly 18 can be incorporated into a footwear item 16 for resiliently and rotatably biasing the footwear item 16 about the axis of rotation 12 or can be worn independently. The resilient assembly 18 can have portions extending to the ankle 14 above the ankle joint 12 and to the foot 15 below the ankle joint 12. The footwear item 16 can be a sock, tights, or a shoe as shown. Resilient rotatable bias in the direction of arrow R can promote rotation of the foot 15 about the ankle joint 12 promoting the lever effect of the foot 15. This can aid the propulsion of each step of a runner, and can increase the speed of a runner in some embodiments about .4 mph.

Figure 2:
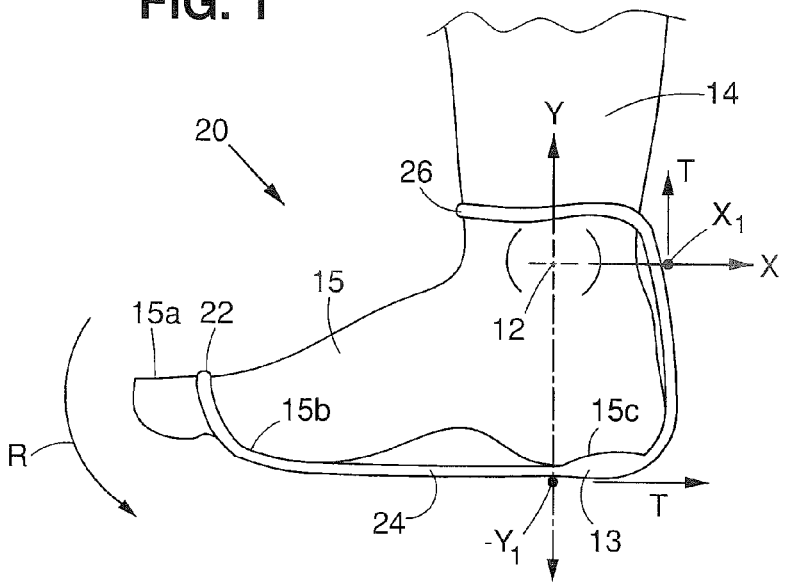
FIG. 2 is a side view of one embodiment of a footwear device.

Referring to FIG. 2, footwear device 20 includes a resilient or stretchable elastic extension portion or member 24 extending between securement members 22 and 26. Securement member 22 can encircle and be secured or connected to the foot 15 in the area of the toes 15*a* and ball 15*b* of the foot 15, and securement member 26 can encircle and be secured or connected to the ankle 14 above the ankle joint 12. The resilient elastic portion 24 can be resiliently stretched in tension to extend around the bottom of the foot 15 from under the ball 15*b* of the foot 15, under and around the heel 15*c*, along the back of the heel 15C and foot 15 to the back of the ankle 14, and can have a widened portion 13 at the heel 15*c*. The resilient elastic portion 24 can be made of an elastic material such as rubber or other suitable elastomeric materials. The securement members 22 and 26 can be elastic, non-elastic, of fixed size, or adjustable, such as with VELCRO® fasteners or other suitable adjustable hardware or configuration. The securement members 22 and 26 can have a snug fit on the foot 15 and ankle 14 to prevent slipping during use. The securement members 22 and 26 can be formed integrally with the resilient elastic portion 24. Footwear device 20 can be incorporated into a shoe, sock, or tights, or independently or separately worn on the foot 15 before insertion into a shoe, sock or tights. The width of securement members 22 and 26, and resilient elastic portion 24 can be varied, for example, made wide for comfort, for example, a band, or narrow to be compact. Additionally, the securement members 22 and 26 can be provided with padding for comfort.

Figure 2A:
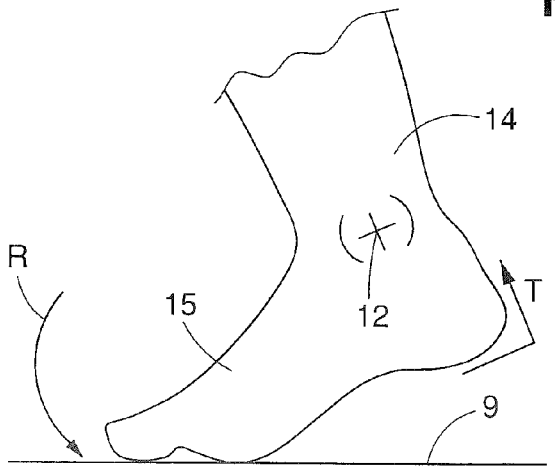
FIG. 2A is a schematic side view of a foot propelled by the footwear device of FIG. 2.

Resilient elastic tension forces "T" generated by the resilient portion 24 can act on the foot 15 at positions offset from the ankle joint 12 along both the X and Y axes for example, at $X_1$ and $-Y_1$. This can generate a resiliently biased moment arm about an axis of rotation such as the ankle joint 12 in the direction of the arrow R for resiliently rotatably biasing distal or lower portions of the footwear device 20 and the foot 15 about an axis of rotation or ankle joint 12, thereby promoting the lever action of the foot 15. The moment arm about the ankle joint 12 in the direction of the arrow R can be formed by both X and Y force components. As seen in FIG. 2A, the resilient rotatable bias of the foot 15 about the ankle joint 12 in the direction R caused by the tension "T" can provide increased pushing off from the ground 9, and can increase the speed of a person's gait.

Figure 3:
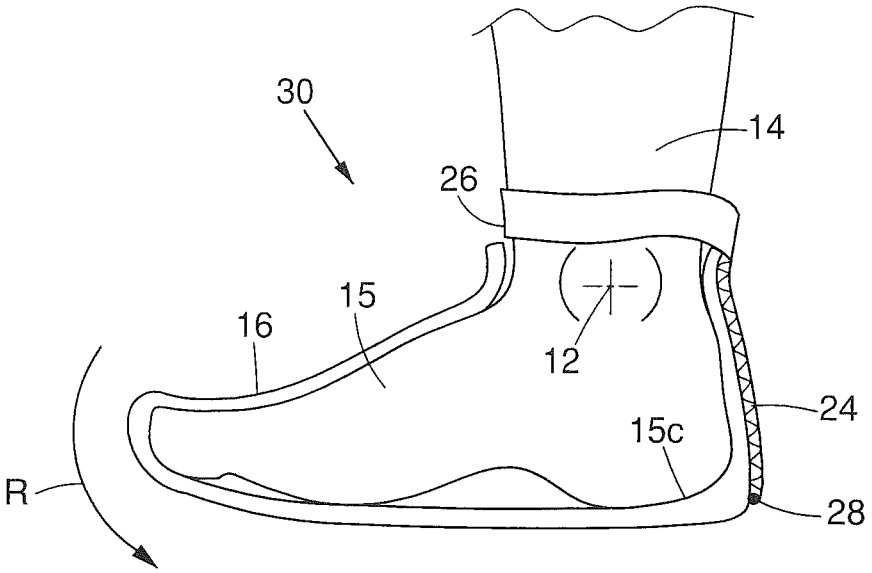
FIG. 3 is a schematic side view of another embodiment of a footwear device.

FIG. 3 depicts another embodiment in which footwear device 30 includes a footwear item 16, such as a shoe which can be resiliently, rotatably biased along with a foot 15 about an axis of rotation or ankle joint 12 by a resilient elastic portion 24 that is secured to the ankle 14 above the ankle joint 12 by a securement member 26, and to the footwear item 16 at an attachment location 28 near the rear and bottom such as at the heel. The resilient elastic portion 24 can in tension, resiliently hold the bottom or sole of footwear item 16 against the bottom of the foot 15 such as against the heel 15*c*. This can also help increase speed by limiting or preventing the foot 15 from lifting in the footwear item 16 during running. The attachment location 28 can be on the outside as shown, or alternatively, on the inside of the footwear item 16. In addition, the attachment location 28 can be along the bottom of the footwear item 16, either on the inside or outside. In some embodiments, the attached location 28 can be at the top rear portion or at the back of the footwear item 16.

Figure 4:
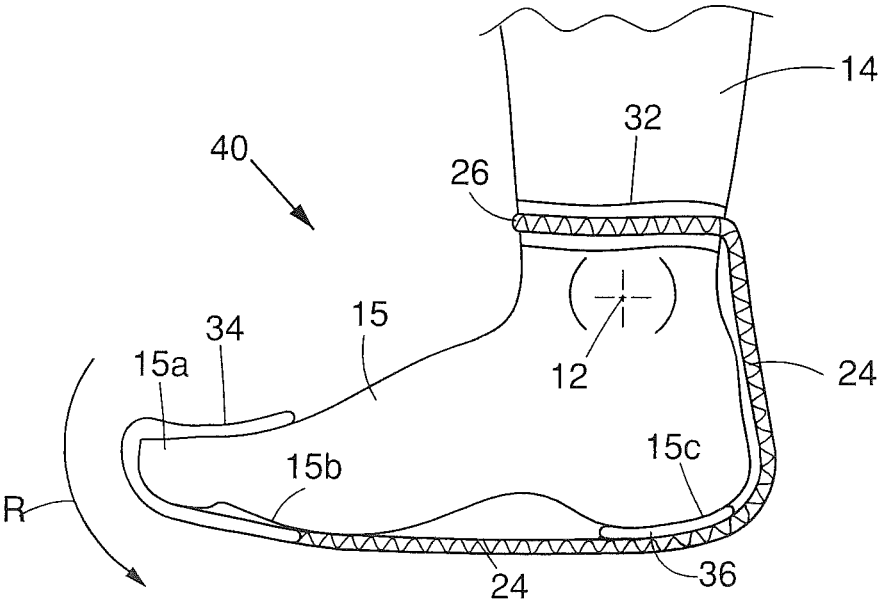
FIG. 4 is a schematic side view of yet another embodiment of a footwear device.

FIG. 4 depicts yet another embodiment in which footwear device 40 includes a toe member or portion 34 surrounding the front of the toes 15*a*. The resilient elastic portion 24 can be secured to the toe portion 34 and extend along the bottom of the foot 15, under and around the heel 15*c* and the back of the foot 15, and can be attached to the ankle 14 above the ankle joint 12 with securement member 26. The securement member 26 can be resilient and can include a band 32 for comfort. Band 32 can be padded, elastic, or non-elastic. Alternatively, the securement member 26 can be non-elastic. The toe portion 34 in one embodiment can be formed of non-elastic material, but alternatively, can be elastic. A pad 36 can provide padding between the heel 15*c* and the resilient elastic portion 24. The resilient elastic forces generated by resilient elastic portion 24 can resiliently and rotatably bias the distal or lower portions of the footwear device 40 and the foot 15 in the direction of arrow R about an axis of rotation or ankle joint 12. Footwear device 40 can be worn on the foot 15 without socks and within a shoe, or under or over socks or tights.

Figure 6:
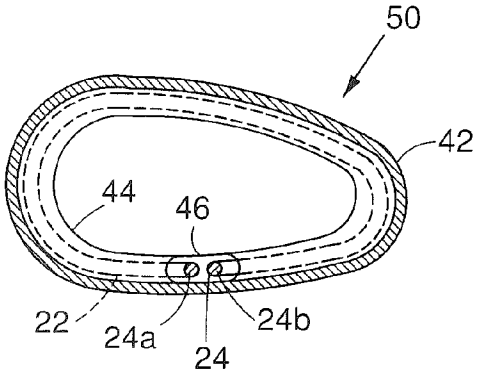
FIG. 6 is a cross sectional view of a portion of the footwear device of FIG. 5.
Figure 5:
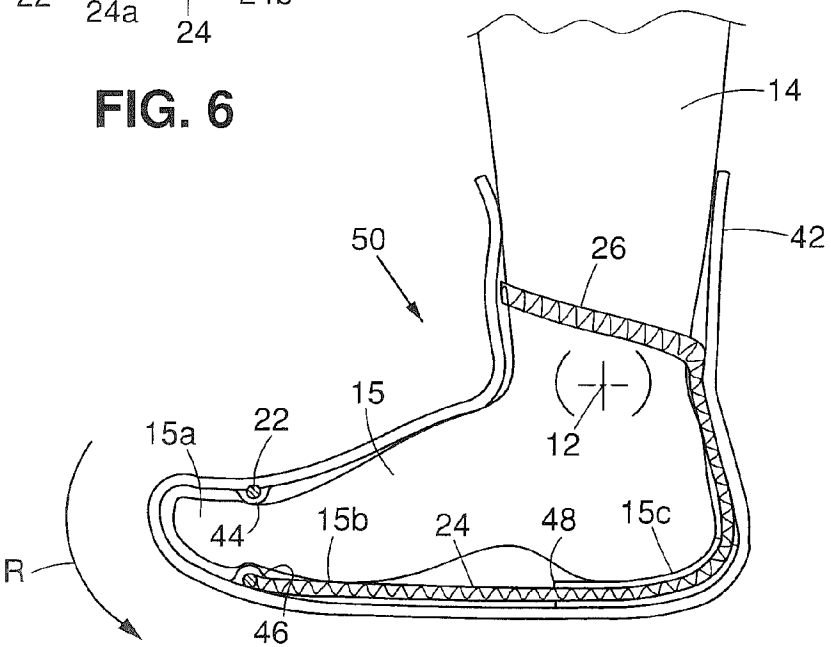
FIG. 5 is a side sectional view of still another embodiment of a footwear device.

FIGS. 5 and 6 depict still another embodiment in which footwear device 50 can include a footwear item 42, such as a sock, in which the resilient elastic portion 24 can encircle the toe region 15*a* in a self tightening loop or noose to form a securement member 22. Alternatively, the resilient elastic portion 24 can be connected to the securement member 22. The securement member 22 can be positioned within a flexible annular channel 44 having an opening 46 at the bottom from which the resilient elastic portion 24 extends. Tension on the resilient elastic portion 24 can tighten the securement member 22 within the annular channel 44 in a noose-like manner around the toes 15*a* and ball 15*b* of the foot 15. The resilient elastic portion 24 can extend through a longitudinal channel 48 formed on the bottom of the footwear item 42. The annular channel 44 and the longitudinal channel 48 can be formed by flexible material, such as fabric, plastic, etc. The longitudinal channel 48 can keep the resilient elastic portion 24 centered under the foot 15 and around the heel 15*c*. Although the longitudinal channel 48 is shown to extend partially along the bottom of the foot 15 in the region of the heel 15*c*, the longitudinal channel 48 can connect with the opening 46 of the annular channel 44. The resilient elastic portion 24 can extend around the rear of the foot 15 and be secured to the ankle 14 above the ankle joint 12 by securement member 26. The securement member 26 can be an extension of the resilient elastic portion 24 that can be formed into a closed or closeable loop or band, and can be within an annular channel 44 around the ankle 14. Alternatively, the resilient elastic portion 24 can be connected to the securement member 26. Consequently, resilient tension generated by the resilient elastic portion 24 can pull the securement band 22 firmly around the toes 15*a* or the forward portion of the foot 15, and additionally exert a resilient rotatable bias on the distal or lower portions of the footwear device 50 and the foot 15 about an axis of rotation or ankle joint 12, downwardly in the direction of arrow R.

Figure 7:
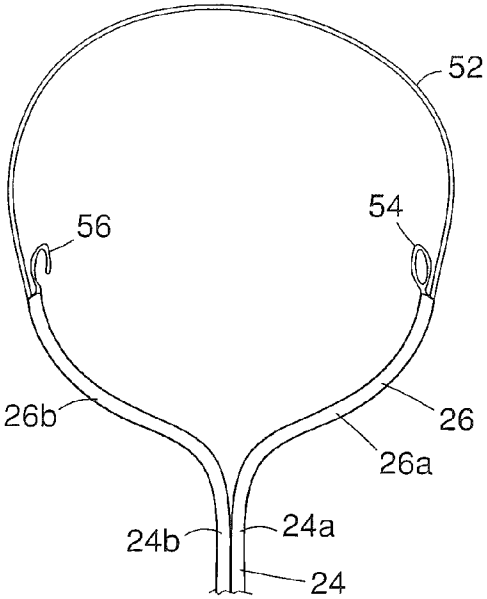
FIG. 7 depicts an embodiment of a securement band.

The securement member 26 can be formed by two resilient portions 26*a* and 26*b* which can be joined together by securement members 54 and 56 at the ends of respective member portions 26*a* and 26*b*. In the embodiment shown in FIG. 7, the securement member 54 can be a loop and securement member 56 can be a hook. Alternatively, other suitable securement methods can be employed, for example, with hook and loop fasteners, buckles, buttons, clasps, knots, straps, etc. A handle 52 can be employed, and can be formed of flexible material such as ribbon, rope, string, shoelace, etc., secured to the ends of portions 26*a* and 26*b* to help resiliently pull the portions 26*a* and 26*b* into position around the ankle 14 for securement to each other. The resilient elastic portion 24 can be formed of two elastic portions 24*a* and 24*b*. Although resilient elastic portion 24 is shown to be inside footwear item 42, in other embodiments, the resilient elastic portion 24 can be on the outside of footwear item 42, or portions can be on the inside as well as on the outside. The footwear item 42 can be a sock, shoe or tights. The securement member 26 can also be self tightening and adjustable. Lifting of the foot 15 within the footwear item 42 can also be limited or prevented.

Figure 8:
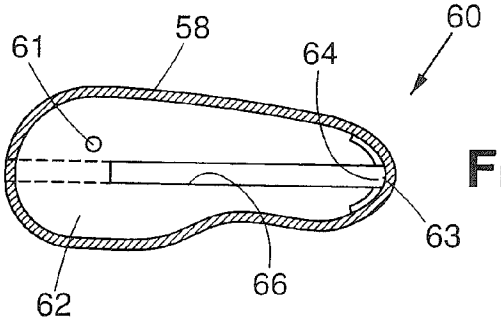
FIG. 8 is a plan sectional view of a shoe showing the inner sole pad surrounded by the outer side walls of the shoe.

FIG. 8 depicts a shoe 60 that can have an inner sole pad 62 with a shape or configuration, such as a slot, channel, depression, recess or indentation 66, extending at least along a portion of the length of the inner sole pad 62 to provide space for allowing the resilient elastic portion 24 of a footwear device worn inside the shoe 60 to more easily stretch and relax. The resilient elastic portion 24 can extend at least partially into the slot 66 which can reduce the amount of pressure and friction forces exerted on the resilient elastic portion 24 by the inner sole pad 62. The upper portion 58 of the shoe 60 can have a heel or rear 64 that is also shaped or configured to reduce the amount of pressure and friction forces exerted on the resilient elastic portion 24, such as with a slot, depression, recess or indentation 63. In some embodiments, the slot 66 can be extended through either the front, rear or both ends of the shoe 60 as shown by the dotted lines and can act as a cooling channel for aiding in the dissipation of heat from the foot 15. Compression of the inner sole pad 62 during foot falls can force hot air out of the slot 66 and expansion thereafter can draw in fresh cooler air, in a bellows-like manner.

Figure 9:
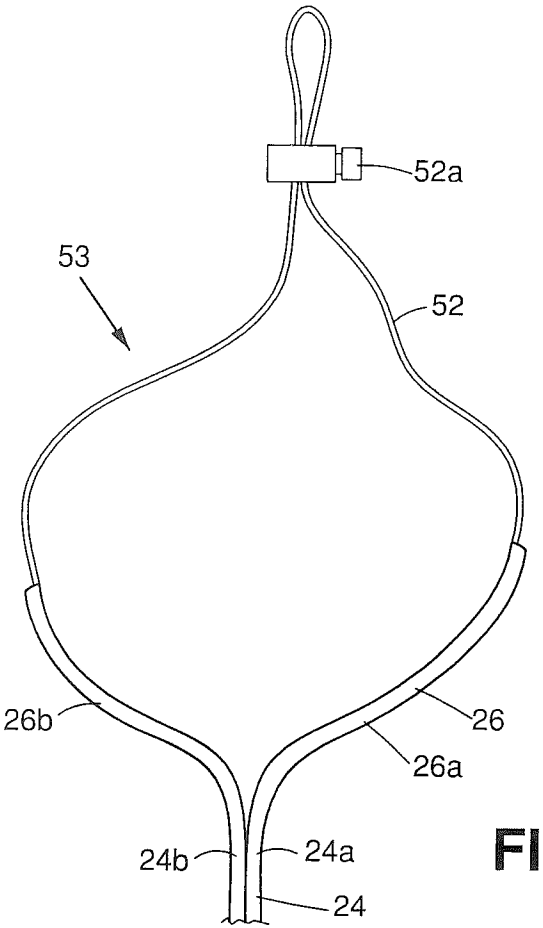
FIG. 9 depicts another embodiment of an arrangement for a securement band.

FIG. 9 depicts another arrangement 53 for securement member 26 which can be adjustably closed or tightened by sliding a spring loaded locking member 52*a* on handle 52. The handle 52 can be an extension of securement member 26, and securement member 26 can be resilient. Adjusting the resilient tension of the securement member 26 can adjust the resilient tension of the resilient elastic portion 24. In one adjustment, the tension of the resilient elastic portion 24 can be for primarily preventing the lifting of foot 15. In another adjustment, the resilient elastic portion can provide resilient biasing of the foot 15 about ankle joint 12 in the direction of arrow R.

Figure 10:
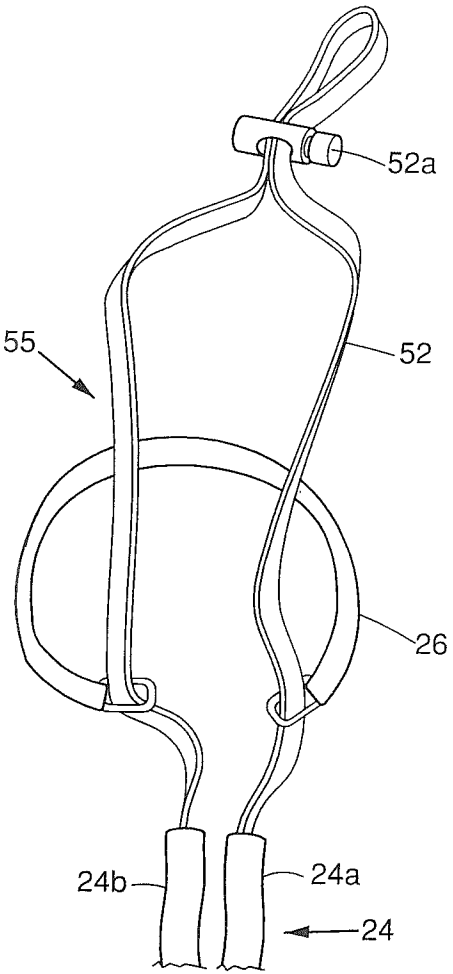
FIG. 10 depicts still another embodiment of an arrangement for a securement band.

FIG. 10 depicts still another arrangement 55 for securement member 26 which differs from the embodiment of FIG. 9 in that a resilient securement member 26 can be slidably attached to the handle 52 and can be adjustably tightened about the user's ankle 14 by sliding the locking member 52*a* on the handle 52.

Figure 11:
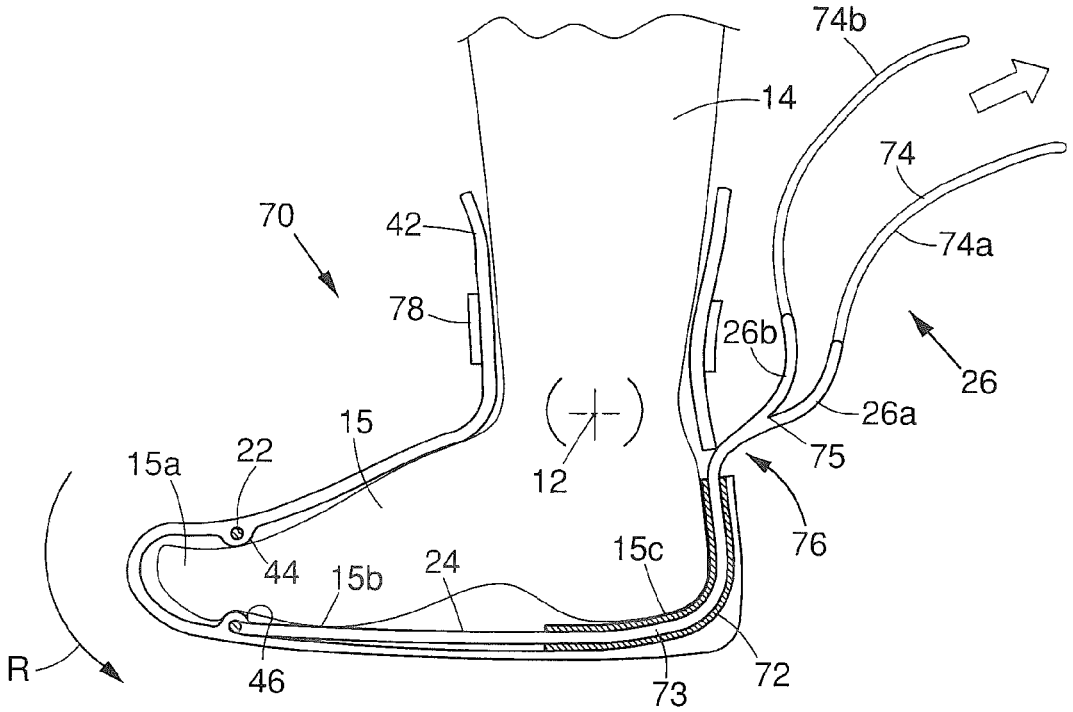
FIG. 11 is a side sectional view of another embodiment of a footwear device.
Figure 12:
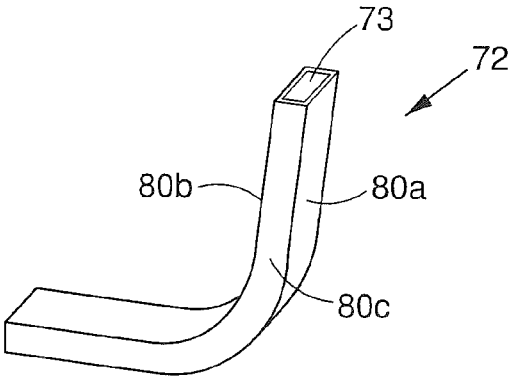
FIG. 12 is a perspective view of an embodiment of a heel member for the embodiment of FIG. 11.

FIG. 11 depicts another embodiment of a footwear device 70 which can differ from footwear device 50 in that footwear device 70 can include a heel member 72 (FIG. 12) having a curved channel 73 through which the resilient elastic portion 24 can extend. The heel member 72 can be curved or contoured to fit in a shoe, and to extend around the heel 15*c* and can have an outer wall 80*a*, an inner wall 80*b* and side walls 80*c*. The channel 73 can have a rectangular cross section as shown, as well as other suitable shapes. The heel member 72 can allow the resilient elastic portion 24 to expand and contract inside the heel member 72 while the footwear device 70 is worn inside a shoe and minimize friction of the resilient elastic portion 24 against the inner sole and back of the shoe. The heel member 72 can be made of thin walled plastic to be low profile for accepting a low profile resilient elastic portion 24, such as in the form of a flat band or a series of low profile strands or bands. The heel member 72 can center and distribute the forces generated by the resilient elastic portion 24 on the heel 15*c*. The heel member 72 can be made to be about the same height or slightly higher than the back of the shoe. The heel member 77 can also be extended to be closer to the ball 15*b* of the foot 15, or up to the securement member 22. In some embodiments, the heel member 72 can have a channel 73 that is open on one side or has more than one side openings.

The securement member 26 and/or resilient elastic portion 24 can extend through a hole or opening 76 in the footwear item 42 for securement of the securement member 26 to the ankle 14 on the outside of the footwear item 42. The securement member 26 can include laces 74 which can be pulled to resiliently stretch the resilient elastic portion 24 and then can be tied or otherwise secured around the ankle 14 above the ankle joint 12. A pad 78 encircling the footwear item 42 can be used to distribute forces of the securement member 26 for comfort. The laces 74 can have first 74*a* and second 74*b* sides which extend from the resilient elastic portion 24. The laces 74*a* and 74*b* can extend from resilient member portions 26*a* and 26*b*, as shown, or can extend from junction 75. The resilient elastic portion 24 can be pulled until the junction 75 comes against the back of the ankle 14. Once the securement member 26 is secured to the ankle 14 above the ankle joint 12, the resilient elastic forces generated by the resilient elastic portion 24 can resiliently and rotatably bias the distal or lower portions of the footwear device 70 and foot 15 in the direction of the arrow R about an axis of rotation or ankle joint 12. In some embodiments, the laces 74 can be inside of the footwear item 42 for securing on the inside. In addition, the securement member 26 can be secured by other suitable means instead of laces, such as means previously described. In other embodiments the heel member 72 and/or the resilient elastic portion 24, can be on the outside of the footwear item. The heel member 72 can be secured to the footwear items 42 by methods known in the art, or alternatively can be unsecured. The heel member 72 can include friction reducing elements, such as rollers. In still further embodiments, the footwear item 42 can be omitted from the footwear device 70.

Figure 13:
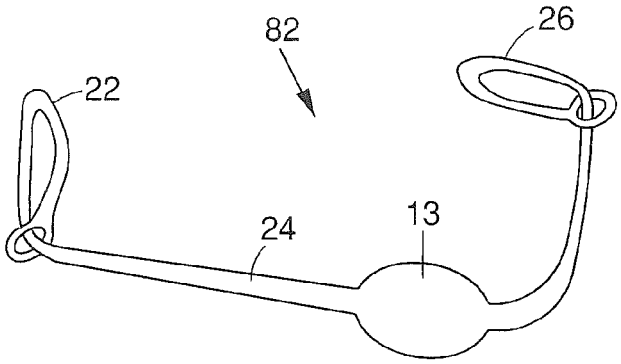
FIGS. 13 and 14A depict other embodiments of a footwear device.
Figure 14A:
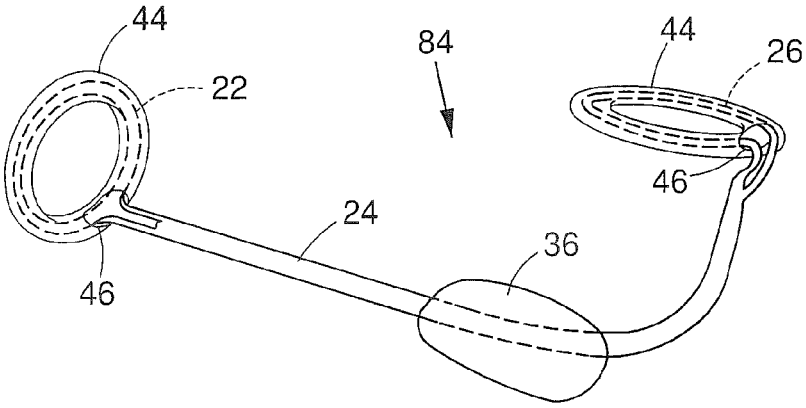

FIGS. 13 and 14A depict other embodiments of footwear devices 82 and 84. Footwear device 82 can have securement members 22 and 26 of a self tightening loop or nooselike construction. The resilient elastic portion 24 can have a widened portion 13. Footwear device 84 can have securement members 22 and 26 having flexible annular channels 44 similar to that in FIGS. 5 and 11. The resilient elastic portion 24 of footwear device 84 can have a pad 36. The self tightening securement members can be used in any of the other embodiments.

Figure 14B:
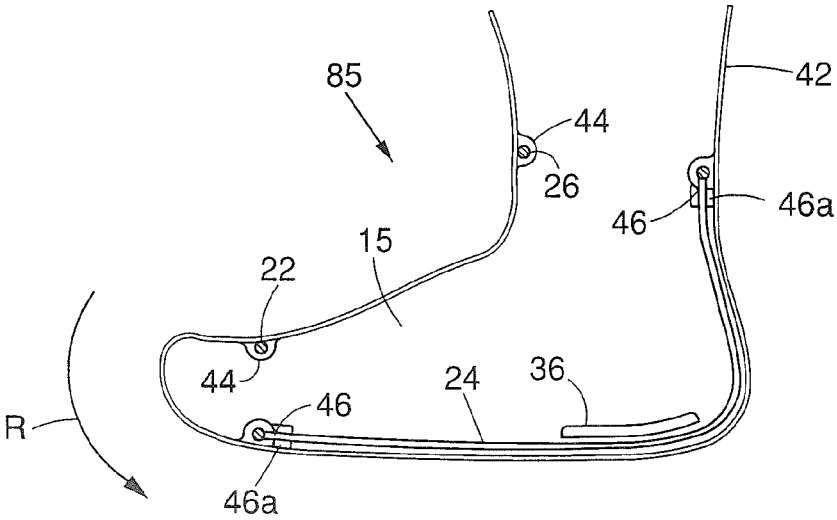
FIG. 14B is a sectional view of another embodiment of a footwear device.

Referring to FIG. 14B, footwear device 85 can include a footwear item 42, such as a sock, shoe or tights, which can incorporate a footwear device similar to footwear device 84. The openings 46 of the flexible annular channels 44 of the self tightening securement members 22 and 26 can have a reinforced or non stretchable member or annular ring of material for keeping strands of the resilient elastic portion 24 close together. A pad 36 can be secured to the footwear item 42 in a manner that can form a channel underneath for the resilient elastic portion 24 to pass through.

Figure 14C:
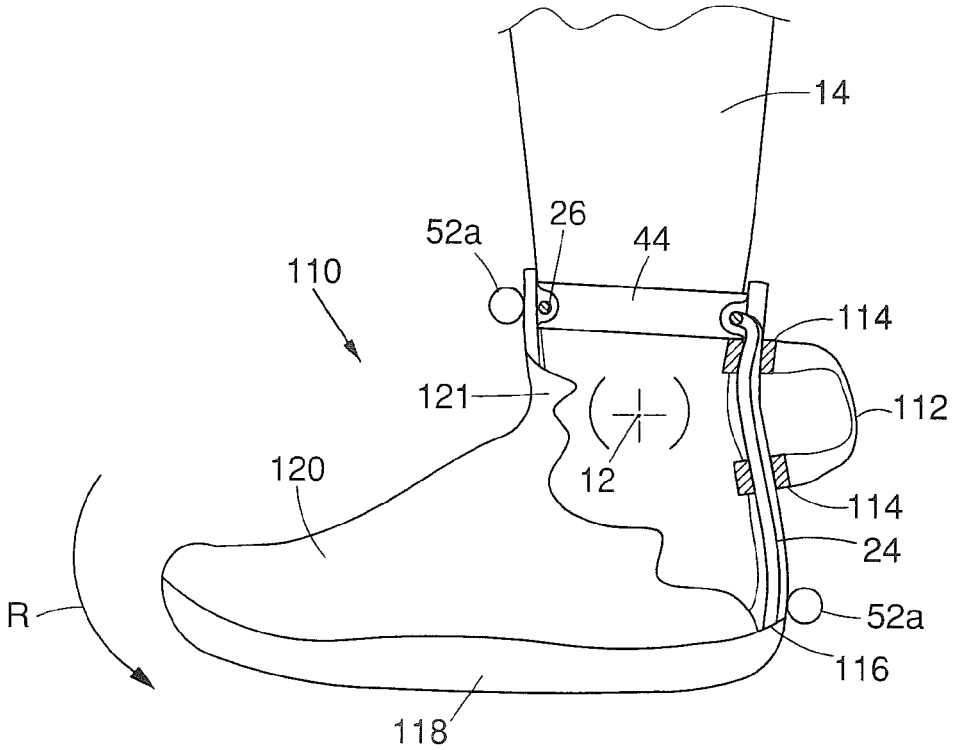
FIG. 14C is a side view of another footwear device with an outer portion removed.
Figure 14D:
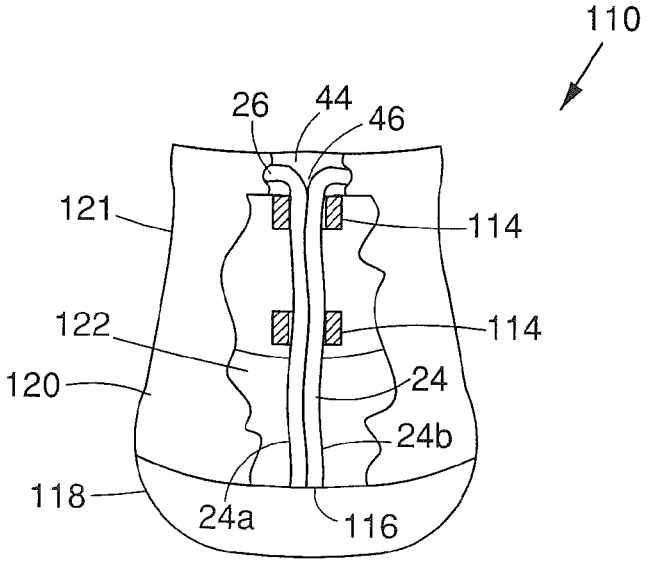
FIG. 14D is a rear view of the footwear device of FIG. 14C with an outer portion removed.
Figure 14E:
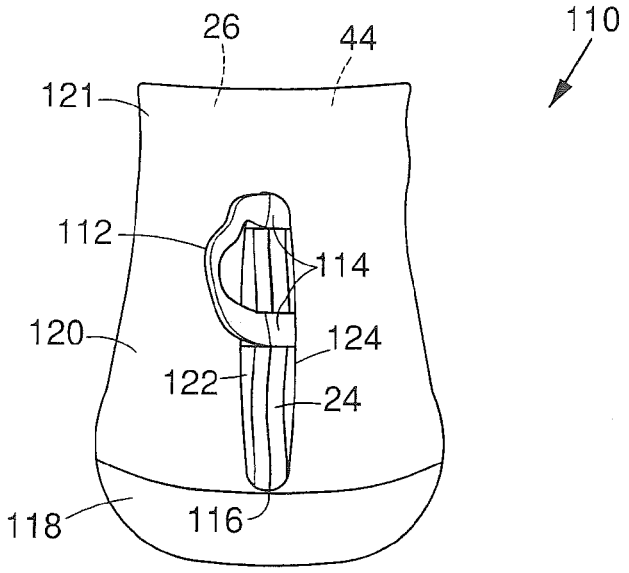
FIG. 14E is a rear view of the footwear device of FIG. 14C.

Referring to FIGS. 14C-14E, footwear device 110 can be a footwear item, such as a shoe, having a sole or shoe bottom 118, and an upper portion 120. The upper portion 120 can have a high or top portion 121 for extending around an ankle 14. If desired, an inner shoe portion 122 can provide support. The high or top portion 121 can be flexible and include a securement member 26 for securement to or around the ankle 14 above the ankle joint 12. The securement member 26 can be self tightening and include a stretchable resilient elastic portion 24, extending within a flexible annular channel 44. The securement member 26 can be similar to that in FIG. 14B. Two elastic portions 24*a* and 24*b* of the resilient elastic portion 24 can extend from a lateral bottom opening 46 in the flexible annular channel 44 and be secured to the rear 116 of the shoe bottom 118. The length of the resilient elastic portion 24 can be sized so that when a foot 15 is inserted into the footwear device 110, and the securement member 26 pulled above ankle joint 12, the two elastic portions 24*a* and 24*b* stretch in tension, tightening the resilient elastic portion 24 within the flexible annular channel 44, thereby tightening the securement member 26 about or around the ankle 14. This also stretches the elastic resilient portion 24 in tension between the securement member 26 and the rear 116 of the shoe bottom 118, resiliently biasing the footwear device 110 and foot 15 about the ankle joint 12 in the direction of arrow R. The shoe bottom 118 can be also resiliently biased against the heel 15*c* during use by the resilient elastic portion 24, which can help minimize or prevent movement of the foot 15 within the footwear device 110 and maximize or increase running speed. A locking member 52*a* can be attached to the securement member 26 for loosening and tightening the securement member 26 and/or the resilient elastic portion 24. Alternatively, the locking member 52*a* can be attached to the resilient elastic portion 24 at the rear 116 of the shoe bottom 118 for loosening and tightening the resilient elastic portion 24 and/or the securement member 26.

In addition, the resilient elastic portion 24 can resiliently bias the foot 15 towards the front of the footwear device 110, further reducing movement of the foot 15 within footwear device 15. As a result, the foot 15 can be sufficiently secured within the footwear device 110, and the upper portion 120, and/or high or top portion 121 does not require laces or straps to secure the foot 15. Alternatively, laces and straps can be included. The upper portion 120 and the high or top portion 121 can be formed of thin light weight material, thereby reducing the weight of the footwear device 110. Weight can also be reduced by the omission of thickened reinforcing materials and laces. Bands 114 can be secured at the opening 46 of the flexible annular channel 44 and to the inner shoe portion 122 to help keep the two elastic portions 24*a* and 24*b* close together. The bands 114 can be connected together by a strap 112 which can be pulled upwardly by the user to help position the footwear device 110 on the foot 15. The rear of the upper portion 120 and top portion 121 can have a slit 124 through which the strap 112 can extend. The location where the resilient elastic portion 24 is secured can vary, and can be at the shoe bottom 118 or if desired, the upper portion 120.

Figure 14F:
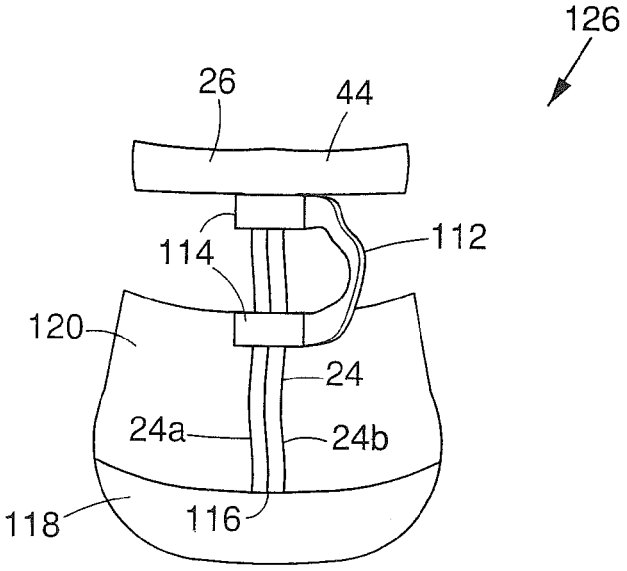
FIG. 14F is a rear view of another footwear device.

Referring to the footwear device 126 in FIG. 14F, the top portion 121 can be omitted so that the securement member 26 is resiliently connected to the shoe upper portion 120 by the resilient elastic portion 24. It is understood that the resilient elastic portion 24 in footwear devices 110 and 126 can be formed by a single elastic portion. In addition, the resilient elastic portion 24 can extend to a securement member 22 in a manner similar to that shown in FIG. 14B.

Figure 14G:
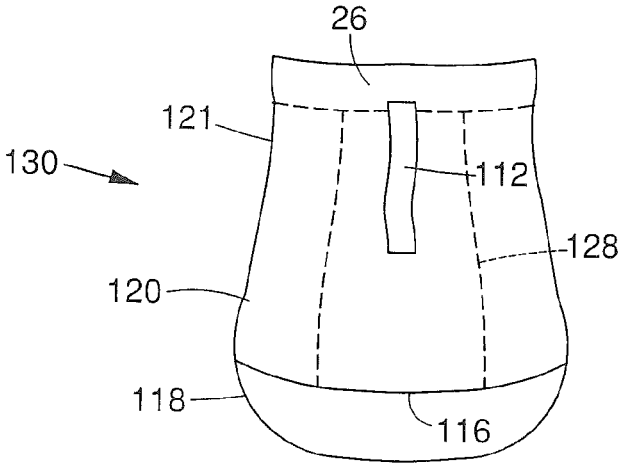
FIG. 14G is a rear view of another footwear device.

Referring to FIG. 14G, footwear device 130 can be similar to footwear device 110, but can include a resilient elastic portion 128 that can be formed as part of the upper portion 120, and high or top portion 121. The resilient elastic portion 128 can be elastic material forming the rear portion of the upper portion 120, and high or top portion 121, or can be secured thereto, or otherwise integrated therein. The securement member 26 can be similar to that in footwear device 110, or any of the other disclosed embodiments. A strap 112 can be included to help position the footwear device 130 on the foot 15, and can help pull the securement member 26 above the ankle joint 12 and around the ankle 14, so that the resilient elastic portion 128 is stretched in resilient tension. In one embodiment, the resilient elastic portion 128 can be a material such as neoprene. The shoe bottom 118 can be a continuation of the resilient elastic portion 128 and can also be formed of neoprene with a layer of rubber. The footwear device 130 can be disposable. A locking member 52*a* can be included for loosening and tightening the securement member 26 and/or the resilient elastic portion 128. The resilient elastic portion 128 can also extend to a securement member 22 in a manner similar to that shown in FIG. 14B.

Figure 14H:
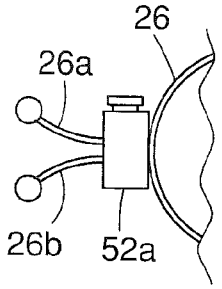
FIG. 14H is a schematic drawing of a locking member configuration.

The securement members 26 in footwear devices 110, 126 and 130 can be worn below the ankle joint 12, and then pulled upwardly above the ankle joint 12 around the ankle 14 when desired. When resilient securement members 26 are worn below the ankle joint 12, the securement members 26 can provide sufficient securement to prevent or limit movement of the foot 15 within the corresponding footwear devices, and can in some applications, be the desired manner of use or wear. The locking member 52*a* can lock ends 26*a* and 26*b* of the securement member 26, for example, as depicted in FIG. 14H, for loosening and tightening securement member 26 and resilient elastic portions 24 and 128. The tension can be adjusted to various levels by the locking member 52*a*. For example, the securement member 26 can be merely secured tight above the ankle joint 12 to hold the footwear device on the foot 15. The securement member 26 can be tightened to a greater level so that the footwear device is upwardly biased against the heel 15*c* by resilient elastic portions 24 or 128 to minimize movement of the foot 15 within the footwear device. The securement member 26 can be tightened further so that the footwear device and foot 15 are resiliently rotatably biased about the ankle joint 12 in the direction of arrow R by resilient elastic portions 24 or 128. Although ends 26*a* and 26*b* are shown in FIG. 14H to be separate, alternatively, the ends 26*a* and 26*b* can be connected together, or can be unitary. Other suitable locking members or arrangements can be employed.

Figure 16:
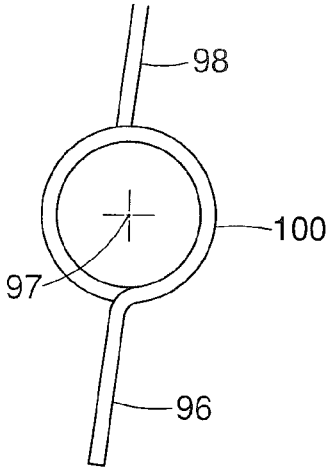
FIG. 16 depicts an embodiment of a torsional spring.
Figure 15:
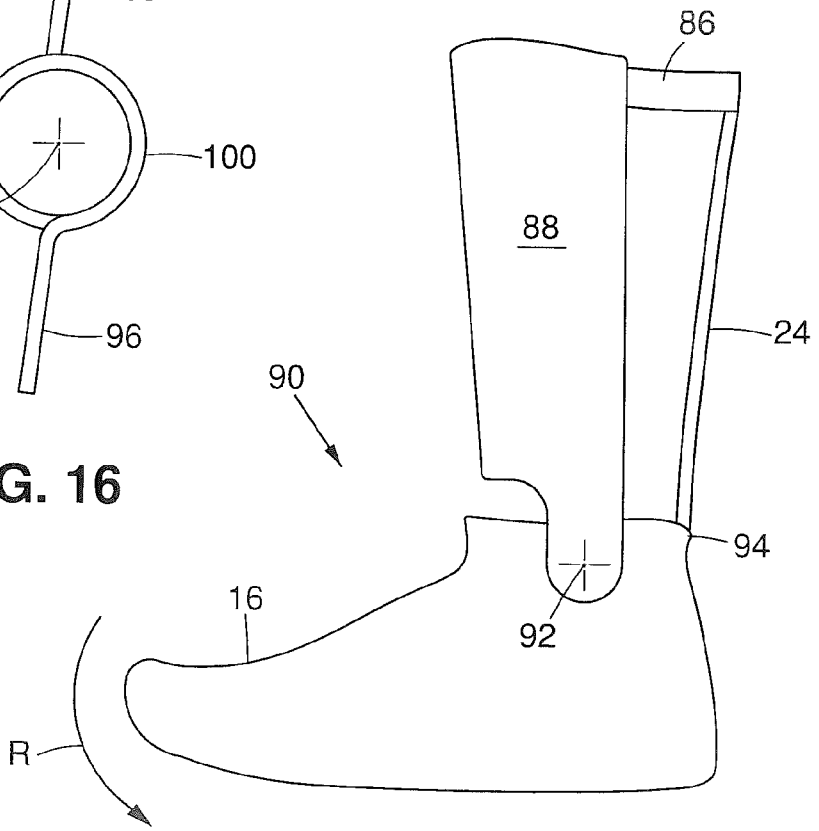
FIG. 15 is a side view of yet another embodiment of a footwear device.

Referring to FIG. 15, footwear device 90 can include a footwear item 16, such as a shoe which can be pivotably connected to a shin guard 88 by a pivot 92. The pivot 92 does not have to coincide with the user's ankle joint 12 but should be at least near the location of the ankle joint 12. The rear portion 94 of the footwear item 16 can be resiliently connected to an extension 86 of the shin guard or member 88 by a resilient elastic portion 24 to resiliently rotatably bias the footwear item 16 and foot 15 about the axis of rotation or pivot 92 in the direction of arrow R. In other embodiments, the resilient elastic portion 24 can be replaced with one or two torsion springs 100 (FIG. 16) where the center axes 97 of the spring 100 can be positioned at the pivot 92 and the arms 96 and 98 can be connected to the footwear item 16 and the shin guard 88.

Figure 17:
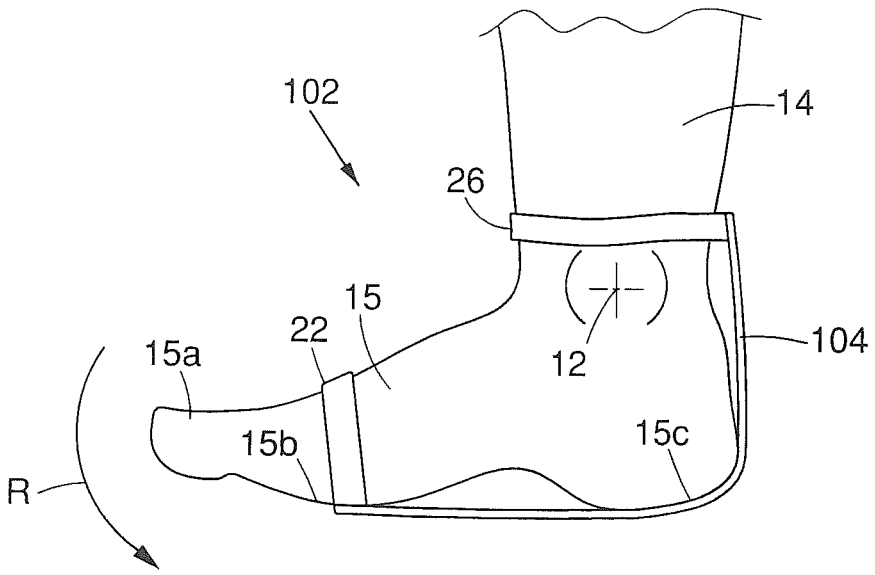
FIG. 17 is a side schematic view of a further embodiment of a footwear device.

Referring to FIG. 17, footwear item 102 can include a leaf spring 104 which can be connected to or secured to the foot 15 by securement members 22 and 26. The leaf spring 104 resiliently can rotatably bias the foot 15 about the axis of rotation or ankle joint 12 in the direction of the arrow R. The leaf spring 104 can have a length compensating arrangement.

Figure 18:
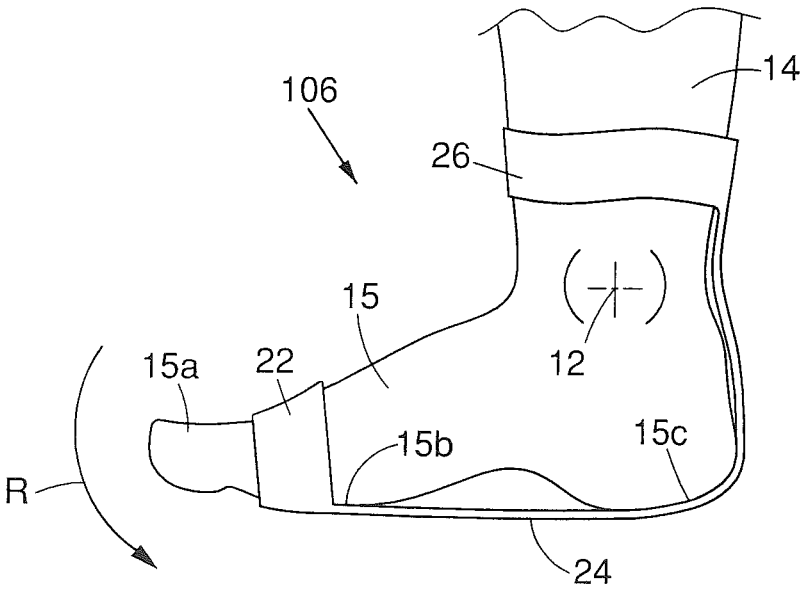
FIG. 18 is a side view of another embodiment of a footwear device.
Figure 20:
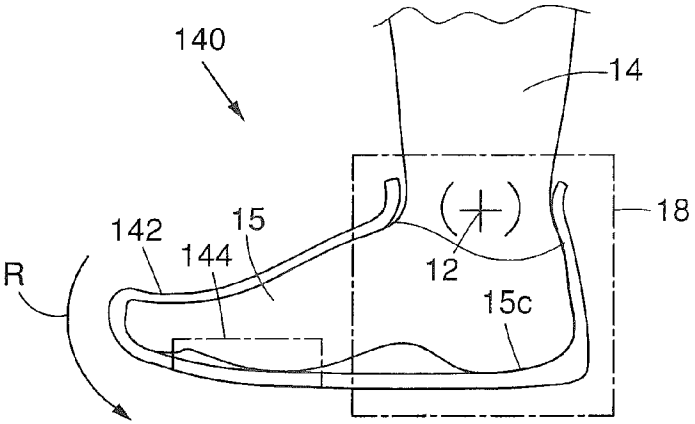
FIG. 20 is a schematic view of another embodiment of a footwear device.
Figure 19:
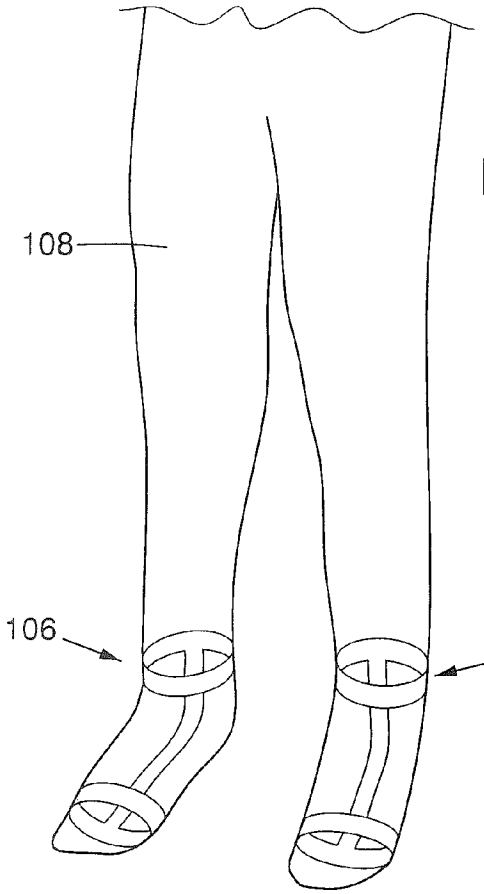
FIG. 19 is a perspective view of a pair of tights including an embodiment of a footwear device.

Referring to FIG. 18 footwear item 106 can have securement members 22 and 26, as well as a resilient elastic portion 24 which are formed from wide elastic material. The footwear item 106 can be incorporated into socks 42, or into tights 108 or a body suit, as depicted in FIG. 19. Alternatively, in other embodiments, the tights 108, socks or body suit can also include any of the other footwear devices, or various features of them described above or shown in the Figures. Referring to FIG. 20, footwear device 140 can include a resilient assembly 18 incorporated into a footwear item 142. The resilient assembly 18 can include any of the features and embodiments previously disclosed for resiliently and rotatably biasing the foot 15 about the ankle joint 12 in the direction of the arrow R, or resiliently biasing the footwear item 142 upwardly against the heel 15*c*. The footwear device 42 can also include structures 144 for promoting windlass effect advantages, in addition to the resilient assembly 18.

Figure 21:
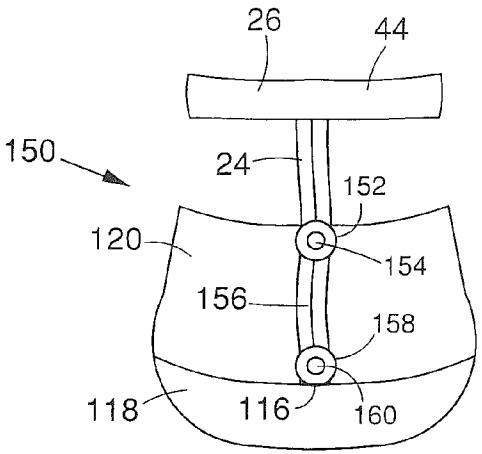
FIG. 21 is a rear view of another footwear device.

Referring to FIG. 21, footwear device 150 differs from footwear device 126 in FIG. 14F in that the resilient eleastic portion 24 extending from the securement member 26 can have a securement member 158, removably engaging a mating securement member 160 attached at the rear 116 of the shoe bottom 118. Alternatively, the resilient elastic portion 24 can have a securement member 154 for removably engaging a mating securement member 152 attached at the rear of the upper portion 120. In other embodiments, the mating securement member 152 can be attached to a lower resilient elastic portion or member 156, extending from the rear 116 of the shoe bottom 118. The securement members 152, 154, 158 and 160 can include protrusions, hooks, rings, loops, etc., and allow attachment and disengagement when desired. The securement member 26 can be incorporated into socks 42 or tights 108. In some embodiments, securement member 26 can be tightened to the ankle by a locking or tightening member 52*a* that can slide and tighten the securement member 26, for example, at the front.

While this invention has been particularly shown and described with references to particular embodiments thereof, it will be understood by those skilled in the art that various changes in form and details may be made therein without departing from the scope of the invention encompassed by the appended claims.

For example, features of the various embodiments can be combined together or omitted. In addition, features of the various embodiments, for example the securement members and the resilient elastic portion, can include further adjustment arrangements or mechanisms than those shown or described. Embodiments having integrally formed securement members and resilient elastic portions, can be molded in one piece. Furthermore, the resilient elastic portions can be detachable from the securement members. It is understood that the securement members and resilient elastic portions can have various combinations of resilient and non resilient portions or components depending upon the situation at hand. Also, the resilient elastic portions or the springs can be replaced with an actuator which becomes actuated by a pressure sensor or accelerator 61 when the foot strikes the ground. The sensor 61 can be, for example, positioned in a footwear item to be under the ball 15*b* of the foot 15, such as in FIG. 8. Also, slippery materials and substances can be employed to minimize friction of components that may slide relative to each other.

What is claimed is:

1. A footwear device comprising:

a resilient member formed of elastic material having first and second ends, the first end configured for being connected to a user' s foot and the second end configured for being connected to the user's leg above the ankle joint with a securement member, the resilient member for resiliently extending at the back of at least one of the user's foot and ankle for resiliently and rotatably biasing the user's foot about the ankle joint, the securement member including a transverse channel, at least a portion of the resilient member extending within the transverse channel of the securement member.

2. The footwear device of claim 1 further comprising a footwear item for wearing on the user's foot.

3. The footwear device of claim 2 in which the securement member is connected to the second end of the resilient member and is configured for securing around the user's ankle.

4. The footwear device of claim 2 in which the resilient member is configured to resiliently extend from the back of the user's foot.

5. The footwear device of claim 4 in which the footwear item is a sock.

6. The footwear device of claim 4 in which the footwear device comprises at least lower portions of tights.

7. The footwear device of claim 1 in which the footwear device is a shoe.

8. The footwear device of claim 1 in which the footwear device is a shoe and further comprises a lower shoe portion, the first end of the resilient member being connected to the lower shoe portion at a rear region of the lower shoe portion.

9. The footwear device of claim 1 in which the resilient member is configured to extend about at least a portion of the ankle.

10. The footwear device of claim 1 in which a portion of the resilient member is a non resilient portion.

11. The footwear device of claim 1 in which at least a portion of the resilient member is configured to extend about the ankle.

12. The footwear device of claim 7 in which the resilient member comprises two side by side elastic portions extending between the securement member and a lower shoe portion.

13. The footwear device of claim 12 in which the shoe includes an upper portion, the channel extending through the upper portion.

14. The footwear device of claim 1 in which the securement member comprises two portions which are secured together with a releasable securement arrangement.

15. A shoe for a foot comprising:

a lower shoe portion; and a resilient arrangement having first and second ends, the first end being connected to the lower shoe portion at a rear region of the lower shoe portion, the second end of the resilient arrangement being configured for being connected above an ankle joint with a securement arrangement for resiliently extending at the back of at least one of the user's foot and ankle for resiliently and rotatably biasing the user's foot about the ankle joint, the resilient arrangement comprising two side by side elastic portions extending between the securement arrangement and the lower shoe portion, the two elastic portions further extending transversely along at least a portion of opposite sides of the securement arrangement.

16. A method of biasing a foot comprising:

connecting a first end of a resilient member formed of elastic material of a footwear device to a user's foot; and connecting a second end of the resilient member to the user's leg above the ankle joint with a securement member, the resilient member for resiliently extending at the back of at least one of the user's foot and ankle for resiliently and rotatably biasing the user's foot about the ankle joint, the securement member including a transverse channel, at least a portion of the resilient member extending within the transverse channel of the securement member.

17. The method of claim 16 further comprising forming the footwear device as a shoe.

18. The method of claim 17 further comprising forming the resilient member to include two side by side elastic portions extending between the securement member and a lower shoe portion.

19. The method of claim 17 further comprising providing the shoe with an upper portion, the channel extending through the upper portion.

20. The method of claim 16 further comprising providing the securement member with two portions which are securable together with a releasable securement arrangement.

* * * * *